United States Patent [19]

Kluth

[11] Patent Number: 5,005,337

[45] Date of Patent: Apr. 9, 1991

[54] ENVELOPE MAILER

[76] Inventor: Alvin J. Kluth, 2247 Oakhill Dr., Green Bay, Wis. 54313

[21] Appl. No.: 464,924

[22] Filed: Jan. 16, 1990

[51] Int. Cl.[5] ..... B65B 11/48

[52] U.S. Cl. ..... 53/460; 53/206; 53/209; 53/462

[58] Field of Search ..... 53/460, 462, 569, 206, 53/207, 209, 266 A; 493/263

[56] References Cited

U.S. PATENT DOCUMENTS

| | | | |
|---|---|---|---|
| 2,307,907 | 1/1943 | Becker | 493/262 X |
| 3,336,726 | 8/1967 | Mayer | 53/206 X |
| 3,593,486 | 7/1971 | Helm | 53/206 X |
| 3,628,304 | 12/1971 | Hornung | 53/460 |
| 3,665,817 | 5/1972 | Katz et al. . | |
| 3,756,127 | 9/1973 | Simpson | 493/263 X |
| 4,003,183 | 1/1977 | Helm | 53/460 X |
| 4,530,730 | 7/1985 | Bradley et al. | 156/227 |
| 4,530,731 | 7/1985 | Bradley | 156/227 |
| 4,531,993 | 7/1985 | Bradley | 156/227 |
| 4,586,651 | 5/1986 | Bradley | 229/68 |
| 4,600,141 | 7/1986 | Bradley et al. | 229/92.7 |
| 4,630,768 | 12/1986 | Bradley | 229/92.7 |

*Primary Examiner*—John Sipos

*Attorney, Agent, or Firm*—Merchant, Gould, Smith, Edell, Welter & Schmidt

[57] ABSTRACT

The present invention allows for producing an envelope by a process in which the envelope is die cut from a continuous paper web, folded in four directions to produce four flaps, glued such that the two side flaps are glued to the bottom flap and the top flap is glued to the bottom flap around the contnets of the envelope. The present invention also allows for in-line printing, stuffing and sealing of the contents of the envelope from plurality of high speed webs of paper for mass mailings and the like. The preesnt invention allows for the in-line making of an envelope by high speed paper web that will produce a four flap envelope with one of the flaps of the envelope, corresponding to one of the directions of folding in the process, to be folded in the opposite direction of the web.

17 Claims, 12 Drawing Sheets

ENVELOPE MAILER

FIELD OF THE INVENTION

The present invention relates to the in-line production of mass mailing envelopes and in particular relates to in-line production of stuffed envelopes having folds in four directions.

BACKGROUND OF THE INVENTION

Production of standard or consumer envelopes in the prior art results in an envelope with folds (flaps) on four sides. The envelope paper stock is die cut to the desired shape, pre-glued on three sides and folded in four directions. These types of consumer envelopes are packaged and sold in boxes for later hand placing of the contents and manual gluing by the owner.

Mass mailings or direct mail requires that the envelope be produced in-line with the contents and be machine stuffed and sealed in an automated fashion to reach economies of scale and efficiency to produce very large numbers in the mass mailing market. The mass mailing market has reached sizes requiring 20 to 50 million pieces of completely addressed pieces stuffed, folded and glued ready for drop mailing by a single date. These requirements have driven the industry to produce in-line envelope stuffing and mailing machines which can handle these large numbers.

Prior art industry machines have produced the contents of the envelope and the envelope in a single pass through a machine for stuffing and mailing to reach economies of scale. The problem with the prior art automated machines is that the envelopes cut, glued and stuffed for mailing have only been folded in two directions. This results in an envelope that has only two flaps, top and bottom, and which has the sides flat-cut and glued together to complete the seal. In contrast to this, manual mailing envelopes and personal mail envelopes are folded in four directions resulting in four flaps with the side flaps glued to the bottom flap and with the top flap pre-glued and left open for later manual stuffing and sealing. The recipient of the mass mailing will readily recognize that a manually stuffed envelope is quite different from an automated stuffed envelope by the folding and gluing differences of the envelope. Since this recognition occurs before opening the envelope, a lower response rate to the mass mailing will result due to immediate discarding.

There is, therefore, a need in the prior art for an automated way of producing mass mailings in which the envelopes are folded in four directions to produce four flaps, the side flaps being glued to the bottom flap, stuffed in an in-line process and the top flap glued to the bottom flap for final sealing of the contents. There is a need in the prior art to produce a high volume of glued, folded, stuffed and sealed mass mailings with no reduction of current machine speeds to meet the present day mass mailing requirements with a product that is indistinguishable from a personally stuffed and mailed envelope.

There is also a need in the prior art for a method of making an envelope by high speed printing and stuffing machines that will produce an envelope from a continuous paper web with one of the flaps of the envelope, corresponding to one of the directions of folding in the process, to be folded in the opposite direction of the web.

SUMMARY OF THE INVENTION

The present invention solves these and many other shortcomings of the prior art which will be understood by those skilled in the art upon reading and understanding the present specification, drawings and claims.

The present invention allows for producing an envelope by a process in which the envelope is die cut from a continuous paper web, folded in four directions to produce four flaps, glued such that the two side flaps are glued to the bottom flap and the top flap is glued to the bottom flap around the contents of the envelope. The present invention also allows for in-line printing, stuffing and sealing of the contents of the envelope from plurality of high speed webs of paper for mass mailings and the like.

The present invention allows for the in-line making of an envelope by high speed paper web that will produce a four flap envelope with one of the flaps of the envelope, corresponding to one of the directions of folding in the process, to be folded in the opposite direction of the web.

BRIEF DESCRIPTION OF THE DRAWINGS

In the drawings, where like numerals refer to like components throughout the several views.

FIG. 2*a* is a detailed mechanical schematic view of the folding bars used to fold the top and bottom flaps of the envelope in the final folding step in the prior art process of FIG. 2.

DETAILED DESCRIPTION OF THE PREFERRED EMBODIMENT

In the following detailed description of the preferred embodiments, reference is made to the accompanying drawings which form a part hereof and in which is shown by way of illustration a specific embodiment in which the invention may be practiced. This embodiment is described in sufficient detail to enable those skilled in the art to practice the invention, and it is to be understood that other embodiments may be utilized and that structural or mechanical changes may be made without departing from the scope of the present invention. The following detailed description is, therefore, not to be taken in a limiting sense, and the scope of the present invention is defined by the appended claims.

Figure 1:
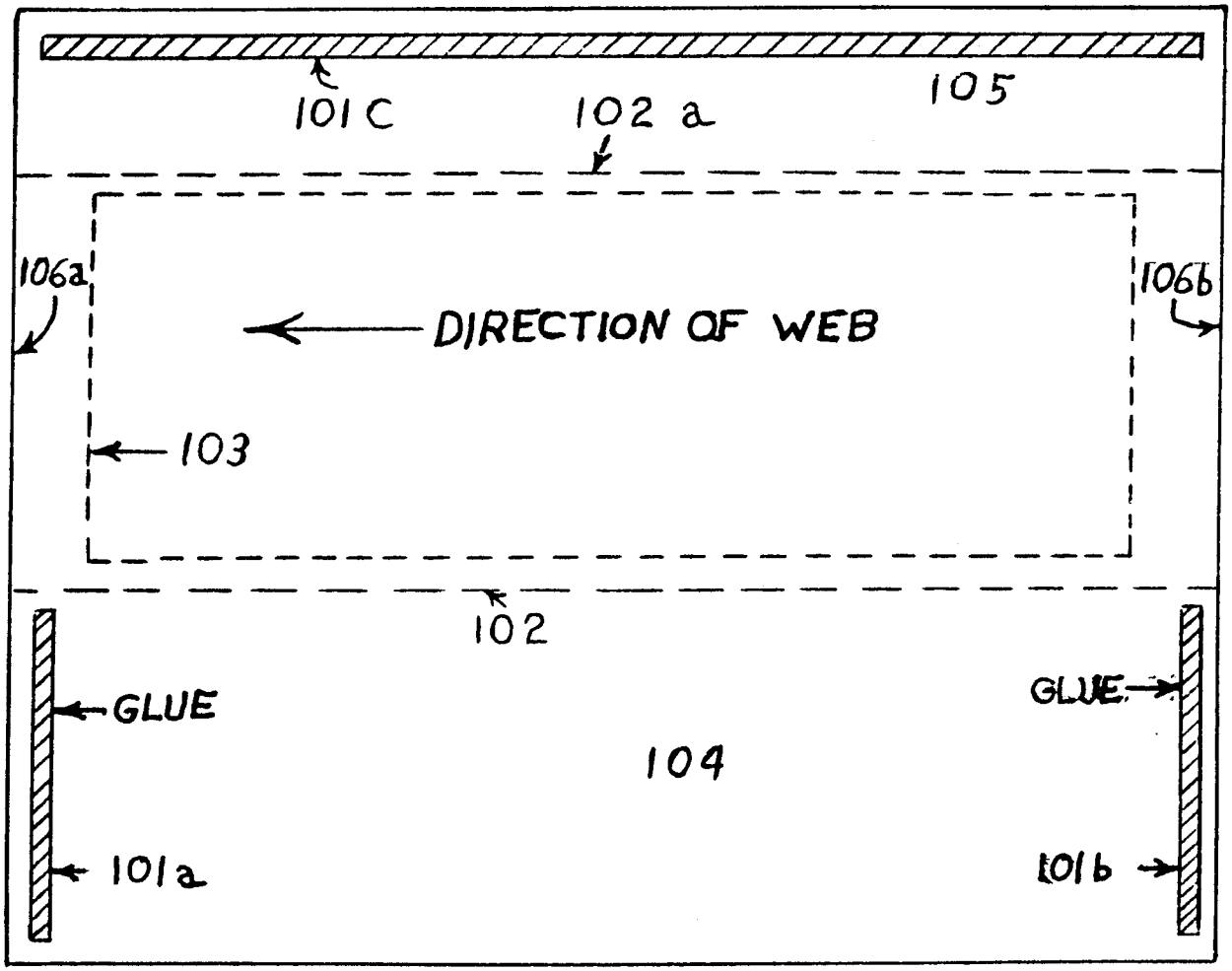
FIG 1 PRIOR ART
FIG. 1 shows a prior art envelope produced by the prior art process of FIG. 2.

FIG. 1 shows a prior art envelope 100 produced by a prior art process for in-line stuffing, two direction folding, three side gluing and sealing of an envelope for mass mailings. The envelope is produced in an in-line process and stuffed in the same line for producing mass mailings.

Figure 2:
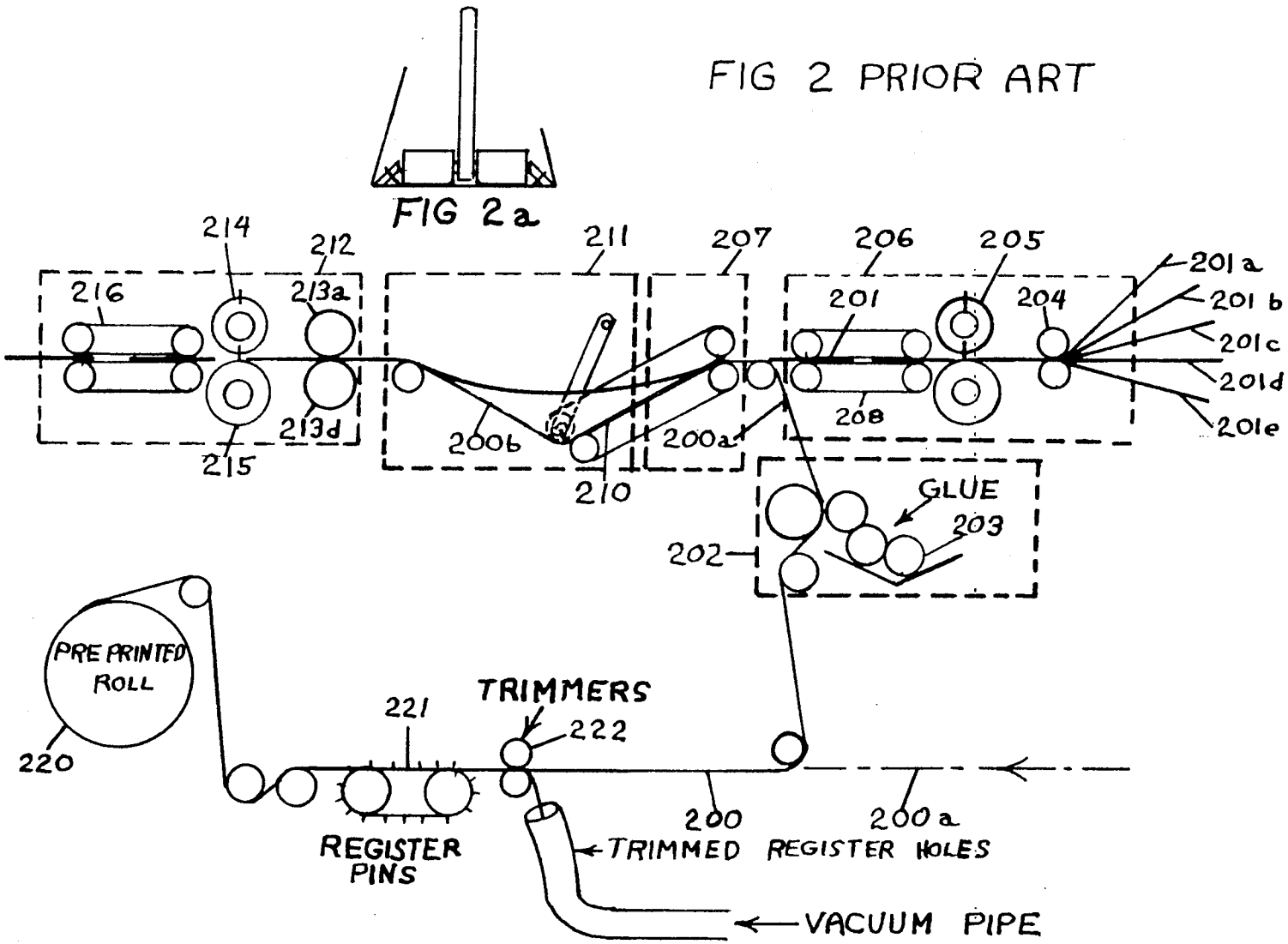
FIG 2 PRIOR ART
FIG. 2 is a mechanical schematic diagram of a prior art process for producing the envelope of FIG. 1 in-line with the contents of the envelope.

FIG. 2, taken in conjunction with FIG. 1, is a side view schematic diagram of a prior art mechanical printing, folding, gluing, stuffing and sealing process for producing the envelope of FIG. 1 of the prior art. FIG. 1 shows a single envelope 100 as part of web of paper moving in the direction shown. The envelope 100 is die cut from the web 200 to have the particular configuration shown or other configurations as desired. Glue is placed at positions 101*a*, 101*b* and 101*c* for later folding and sealing of the envelope The envelope is folded at points 102*a* and 102*b* in the in-line process by "plow folding", an industry term for in-line folding of the web. Other prior art folding techniques are also used.

Referring to FIG. 2, an in-line process for producing the envelope of FIG. 1 is shown in a side schematic view. The paper web 200 for the envelopes is fed into the process of FIG. 2. Paper web 200 is sometimes sourced from a preprinted roll 220 which is synchronized in register with the process of FIG. 2 using register pins 221 with the registration trimmed off at 222 where the trimmed portion is vacuumed away by trim pipe 223. Also practiced in the art, paper web 200 is sourced from other places 200*a* such as other printing presses, collators or other sources (not shown).

Glue is applied to the web 200 at station 202 by application cylinders 203 at the appropriate points or patterns of the web 200 at positions 101*a*, 101*b* and 101*c* of envelope 100, as shown in FIG. 1. The glued envelope web 200*a* is merged with a plurality of webs 201*a*–201*e* which represent the contents of the envelope to be stuffed. Webs 201*a*–201*e* represent pre-printed webs of mass mailing information to be placed in the envelope for mailing to a consumer, customer or recipient. The webs are merged by pinch cylinder 204 and pre-cut by cutters 205 all within station 206. The contents from station 206 are merged with glued web 200*a* at station 207 where the speed of the contents for the envelope and the glued envelope web 200*a* are matched. The contents are placed or positioned on the envelope web according to dashed outline 103 shown in FIG. 1. Referring once again to FIG. 2, envelope web 200 with contents 201 continue to be fed to the left in FIG. 2 to be pinched between belts 209 and 210.

The envelope web 200*b* with contents 201 is folded at station 211. The web 100*b* is folded at lines 102*a* and 102*b* as shown in FIG. 1 so that the flaps 104 and 105 are folded over the contents situated at position 103 within envelope 100.

FIG. 2A shows a detailed view of the folding process done in a conventional manner known as plow folding which alternatively is accomplished by the prior art method of shoe folding. The two flaps are folded in two directions around the contents of the envelope for later gluing and sealing. Station 211 dips the web 100*b* into a v-shape to facilitate the folding process. As is practiced in many prior art paper handling machines, a completely flat web cannot be folded in line without the web "tubing". By dipping the web into a v-shape, the side stresses are compensated for the v-shaped web to prevent tubing.

Station 212 pinches the folded web with pinch cylinders 213*a* and 213*b*. The pinching of the folded web causes glued positions 101*a*, 101*b* and 101*c* to seal the envelope since during a high speed web the glue remains wet from application at station 202. The web is then die cut by cutoffs 214 applying against hardened anvil cylinder 215. Referring briefly to FIG. 1, the cuts are at positions 106*a* and 106*b*. The periphery of the envelope 100, edge 105*a* of one envelope being the same as edge 105*b* of the subsequent envelope.

The result is fed between pinch belts 216 to a receiving station (not shown) where the envelopes are waiting to be addressed and mailed. The envelope web can be pre-addressed at any point along the process, for example, on preprinted roll 220, from press web 200*a*, between stations 202 and 207, between stations 207 and 211 or after station 212. The addressing of the envelopes may be by direct impression printing, electrostatic or electronic printing and other methods known and used in the art.

Webs 201*a*–201*e* are spaced when merged with web 200*a* to provide the spacing between the contents of the envelopes. This is accomplished with speed differential merging of the webs so that 200*a* is moving at a slightly faster rate than webs 201*a*–201*e*. This differential speed and synchronization is by conventional means in the art.

Figure 3:
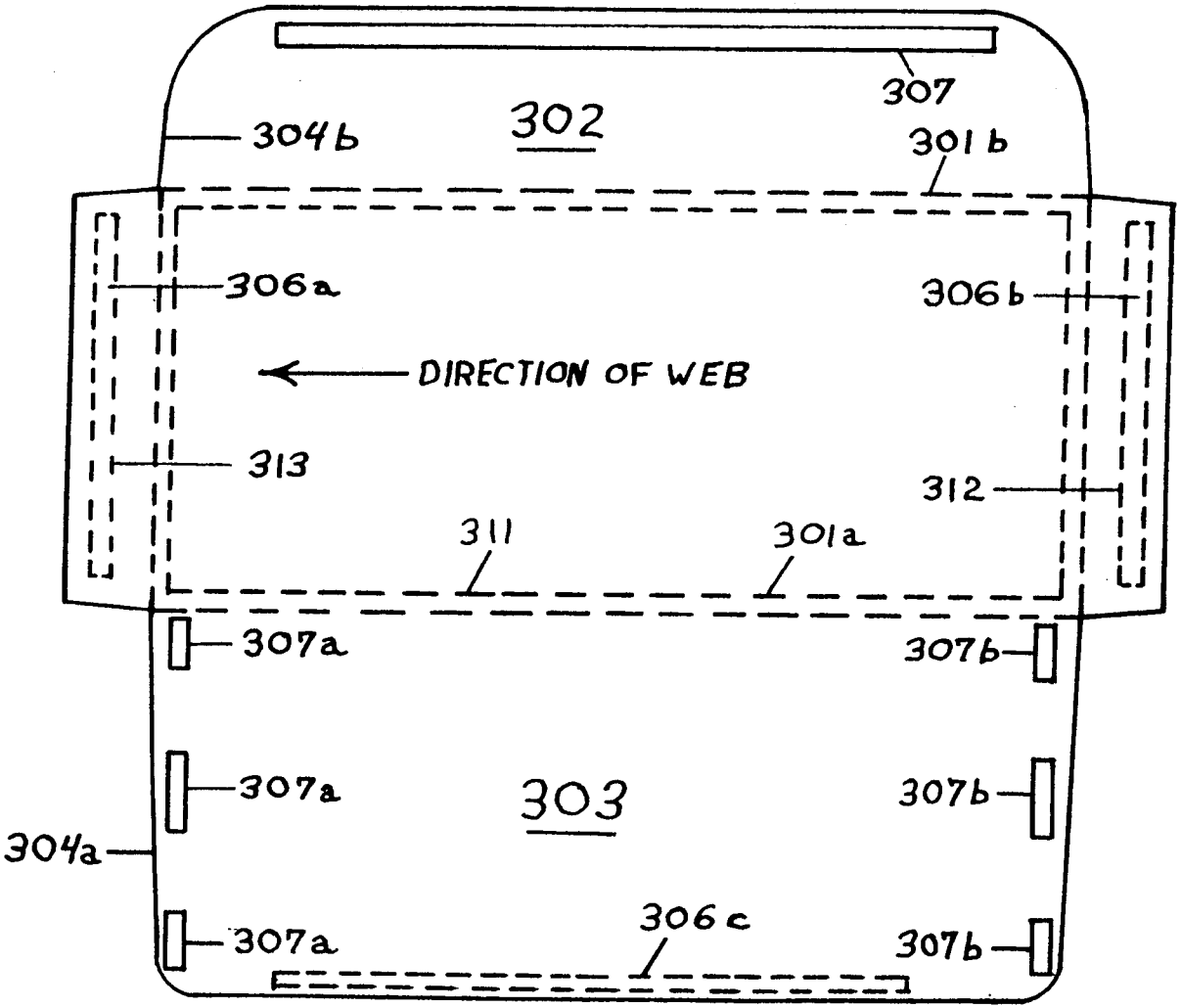
FIG. 3 shows a four-fold envelope made from the method of the present invention.
Figure 4:
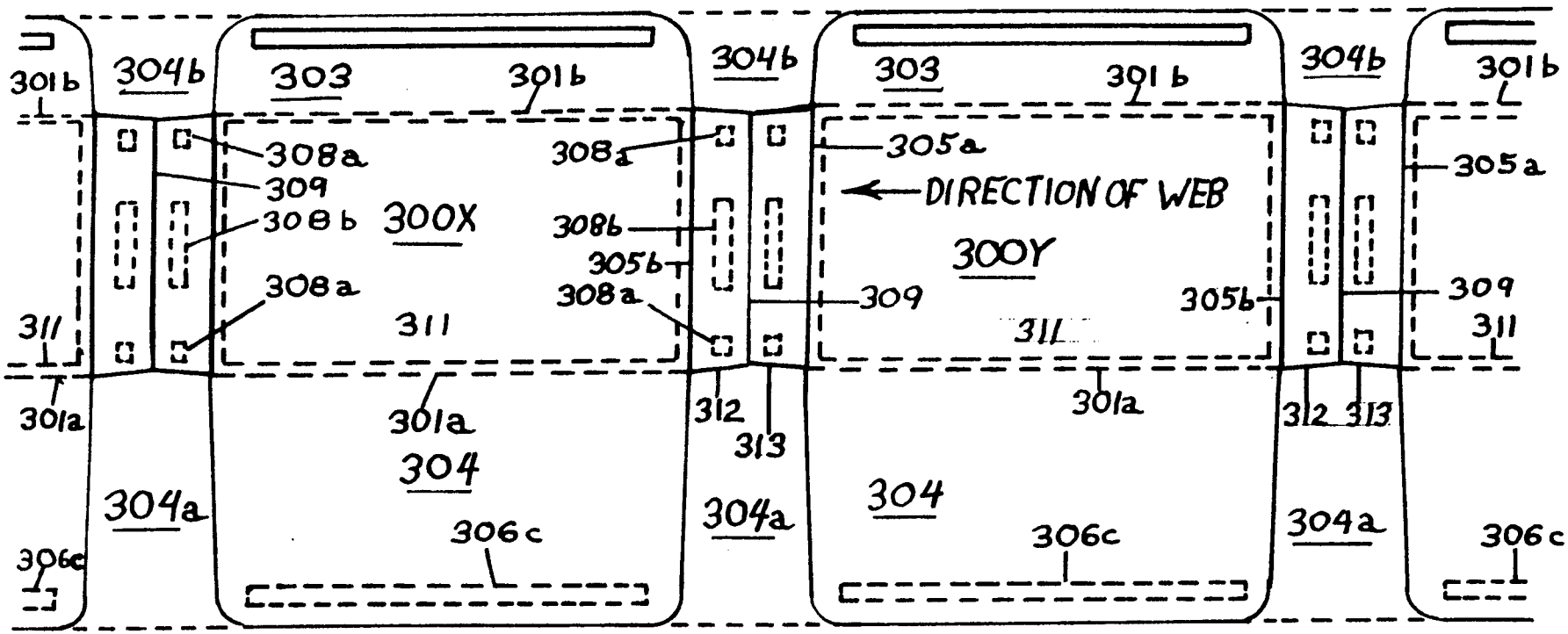
FIG. 4 shows two of the envelopes of FIG. 3 in an intermediate stage of the process as part of a continuous web.
Figure 5:
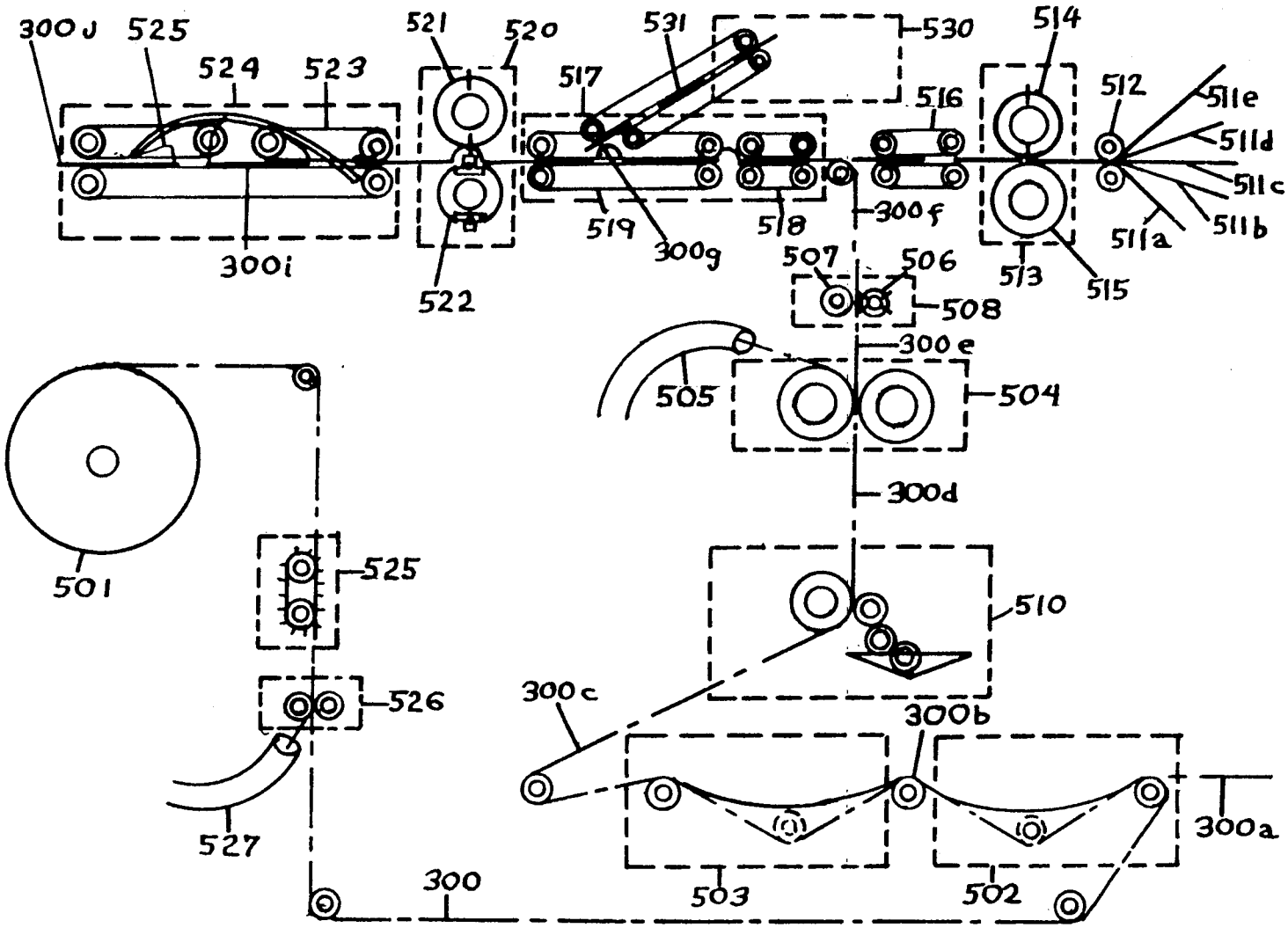
FIG. 5 is a mechanical schematic diagram of the process of producing the four-fold envelope of FIG. 3 in-line with the contents of the envelope and automatically stuffing and sealing the envelope.

FIG. 4 shows a portion of a continuous web 300 produced by the preferred embodiments of the present invention. FIG. 4 shows a die cut, scored, glued and partially folded continuous web of envelope material for later stuffing, folding and gluing for mass mailing. Referring to FIGS. 3, 4 and 5 in conjunction, FIG. 5 shows a method and apparatus of producing the envelope of FIG. 3 from the web of FIG. 4. A bulk roll 501 supplies the bulk paper material for the production of the envelope web of FIG. 4 running in the longitudinal direction shown. Roll 501 may be raw paper stock or it may be preprinted material which is registered at station 525, trimmed at station 526 and the trimmings vacuumed by pipe 527 in a manner similar to that described in conjunction with FIG. 2. Also in the alternative, envelope web 300*a* may be received from another printing station or press, a collator or other sources (not shown).

The envelope web 300 is applied to station 502 where a pre-fold is placed at positions 301*a* and 301*b* as shown in FIGS. 3 and 4. The pre-fold is accomplished by known methods such as shoe folding, plow folding or other folding methods such as the type described above in conjunction with FIGS. 2 & 2*a*. The folded continuous envelope web of FIG. 4 is unfolded at station 503 using unfolding bars applied to flaps 302 and 303. Envelope web 300 at position 300*c* results in a continuous web of paper being pre-folded and unfolded at positions 301*a* and 301*b*.

Referring once again to FIG. 5, the web 300*c* has been folded and unfolded and is then presented to optional glue station 510 at the optional location shown in FIG. 5. The position of the glue station 510 in the preferred embodiment is placed after the unfolding station 503; however, it may be placed at different optional locations along web 300.

In the preferred embodiment, glue is applied to the top side of web 300*c* at positions 307, 307*a* and 307*b*. Positions 307, 307*a* and 307*b* may be continuous or discontinuous portions of glue. Also, glue station 510 shows glue being applied to one side of web 300*c* in the preferred embodiment. Those skilled in the art will readily recognize that glue station 510 may be arranged to place glue on the other side of web 300*c*, or on both sides of the web, as described in more detail below.

In an alternate embodiment, the glue may be applied to positions 306*a*, 306*b* and 306*c* to the backside of the envelope of FIG. 3 in a continuous or discontinuous fashion. In another alternate embodiment, glue may be applied to two sides of the envelope 300 such that glue is applied to positions 306*a* and 306*b* on the backside and glue is applied to position 307 on the front side to form a more conventionally glued envelope. In one preferred embodiment, glue station 510 is optional for glue positions 306*a* and 306*b* since this glue may be applied by the anvil 522 of station 520, as described more fully below. In this preferred embodiment, glue station 510 may still be required for the application of glue at position 307.

An optional means of gluing which facilitates the handling of the web is shown on the web 300 in FIG. 4. Side flap glue positions 308*a*, 308*b* and 308*c* are segmented across the flap to allow blank areas between the glued segments for handling of the web without the smearing of the glue. In an alternate embodiment, the glue may be applied in dots within preselected positions for the same reason of facilitating the handling of the web without smearing the glue.

Web 300*d* is applied to a die-cut station 504 which takes out positions 304*a* and 304*b* to begin creating the top 303 and bottom 304 folding edges or flaps of the envelope cut from the sides of the paper web transverse to the direction of the web. Those skilled in the art will readily recognize that a wide variety of die cut configurations could be used to tailor the ornamental features of the envelope. For example, curved corners on the paper could be accomplished with curved die cuts to make the flaps of the envelope more presentable. Suction pipe 505 is used in FIG. 5 to remove the excess die cut material taken from sections 304*a* and 304*b*.

The envelope web at 300*e* is now pre-glued and die cut in a configuration shown in FIG. 4. Web 300*e* is then applied to score station 508 where the paper is scored at positions 305*a* and 305*b*. The scoring is accomplished by running the web between a scoring blade cylinder 506 and a resilient anvil cylinder 507 such that the score blades impress through the paper web 300 into resilient cylinder 507 making an impression through the paper without severing the paper. The scoring makes the paper more flexible for later high speed folding.

Figure 5A:
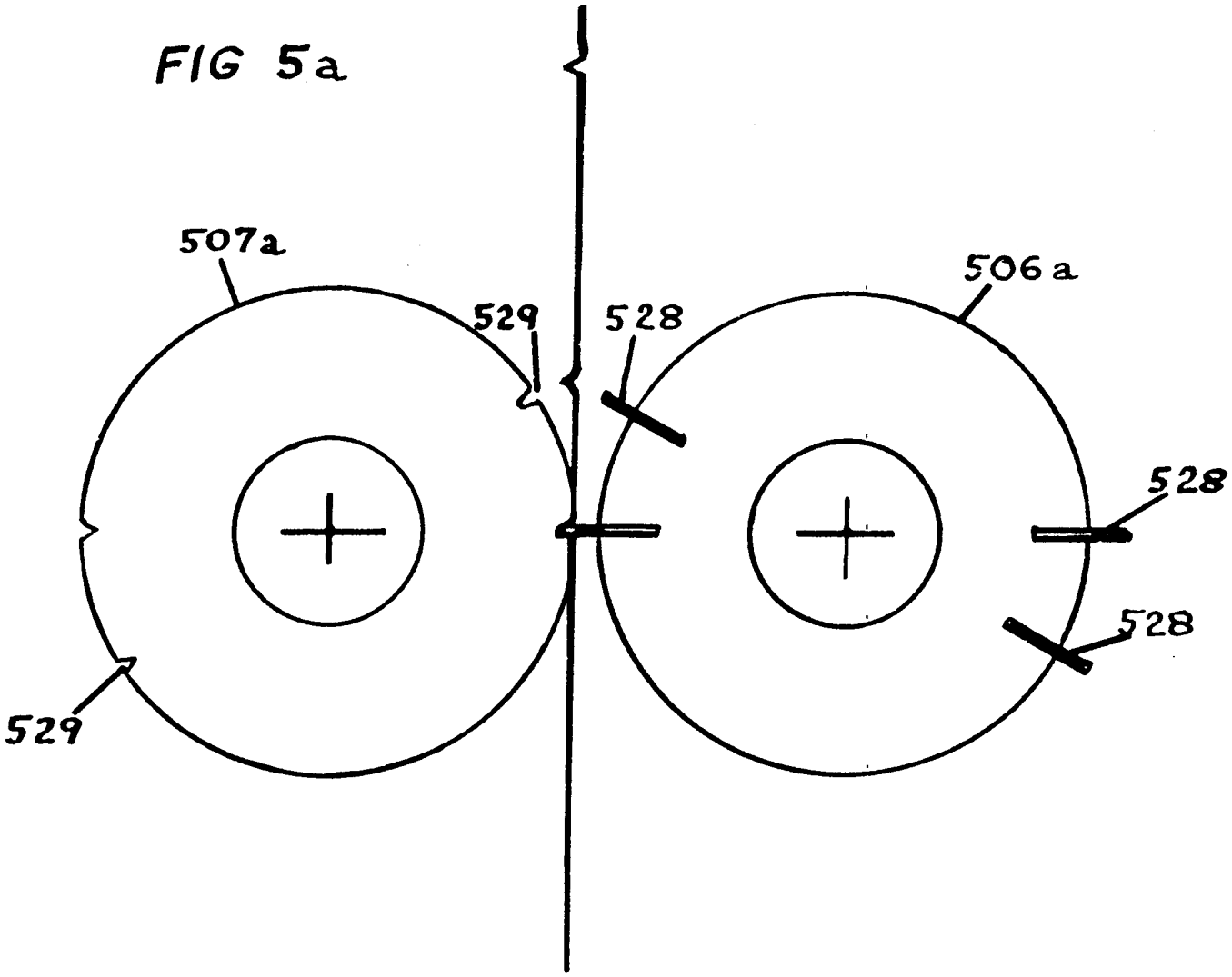
FIG. 5*a* is a detailed mechanical schematic view of the scoring step in the process shown in FIG. 5.

In an alternate embodiment, the scoring function at station 508 may be accomplished with male and female non-resilient cylinders running in registration. Referring to FIG. 5A, cylinder 506*a* having blades 528 coincide with slots 529 or depressions 529*a* on female non-resilient cylinder 507*a* to accomplish this scoring at station 508.

The scoring at position 305*a* and 305*b* of the web 300 shown in FIG. 4 may also facilitate the handling and non-smearing of the glue since after scoring at these lines there is a natural tendency for the web to tent or buckle at position 309 if a speed differential is applied to the web between envelopes 300*x* and 300*y*. The tenting or buckling at position 309 will allow the glued portions 308*a*, 308*b*, 308*c* or 308 generally to remain away from the handling mechanisms without smearing the glue.

In an alternate preferred embodiment of application of the glue at station 510, the glue may be applied to the front face of web 300 shown in FIG. 4 at position 307*a*. The glue applied at the front face at positions 307*a* would be in place of glued positions 308*a*–308*c* also shown in FIG. 4. This optional form of gluing would still result in the side flaps being sealed upon folding at the later stage. In the alternative, single strips of glue may be applied rather than the segments 307*a* or 308*a*–308*c* if smearing of the glue can be prevented during handling.

As described in conjunction with FIG. 3, back side glued position 306*c* is an alternate embodiment of front side glued position 307. As shown in the continuous web 300 of FIG. 4, glued position 306*c* is the back side gluing method as an alternative to front side gluing position 307. Those skilled in the art will readily recognize that glued positions 306*a* and 306*b* would be used in conjunction with glued position 306*c*. Also, alternate embodiment glued positions 308*a*–308*c* would be used in conjunction with glued position 306*c* to facilitate single side gluing. Also, those skilled in the art will readily recognize that glued position 307*a* would preferably be used with glued position 307 for same side gluing. Those skilled in the art will readily recognize that combinations of the above may be used for double side gluing if desired.

Referring once again to FIG. 5, webs 511*a*–511*e* are continuous webs of printed matter to be included in the folded, glued and sealed envelope for the end result of the mass mailing production. Pinch cylinders 512 combine the webs for cutoff station 513. In addition to webs 511*a*–511*e*, a placer station 530 may be used to insert additional material 531 for inclusion in the mass mailing product, for example, pre-printed envelopes for return mailing. The placers may also be used to insert other pre-produced items into the web such as samples, keys, color photographs, etc. In an alternate embodiment, the placer station 530 may be used instead of webs 511*a*–511*e* to completely supply the insert material for web 300.

Cut-off station 513 cuts the plurality of webs 511*a*–511*e* at predetermined positions using cut cylinder 514 against anvil cylinder 515. Those skilled in the art will readily recognize that cutoff station 513 may use a number of methods for cutting the web at predetermined positions.

The insert materials, generally 511, exit cut station 513 and are conveyed along conveyor belts 516 for merging with envelope web 300*f* which then acts as a carrier web for the precut insert material 511. The precut insert material 511 is merged at the same speed as envelope web 300*f* so that the precut insert materials are positioned at positions 311 as shown in FIGS. 3 and 4.

The materials 511 and continuous envelope web 300*f* are fed through speed differential station 517 in which conveyors 518 are operating at a slightly greater speed than conveyors 519. The differential speed between conveyors 519 and 518 will cause tenting or buckling at position 300*g* of web 300 corresponding generally to position 309 shown in FIG. 4. The webs 300*g* and 500 lie on the lower belts of conveyors 519 and 518; however, the upper belts of the conveyors 519 and 518 can only contact the web 300*g* at flap positions 303 and 304 so that the tent is not crushed at position 309.

Those skilled in the art will readily recognize that the speed differential may be accomplished at a variety of positions along web 300. For example, the tenting 300*g* would not be necessary with some of the gluing options described in conjunction with glue application station 510. Differential speed may be applied at cutoff station 520 between the input and output of station 520. For example, when gluing options 308*a*, 308*b* and 308*c* on the back side of the side flaps of envelope web 300, tenting or buckling at position 300*g* is required to keep the glue away from the continuous rollers used to convey webs 511 and 300 together. Since continuous rollers or bed plates may be required to convey materials 511 with envelope web 300 during the later cutoff stages, gluing at positions 308*a* through 308*c* without tenting or buckling at position 300*g* would cause a smearing of the glue. If, however, gluing were applied at position 307*a* along with same side gluing at position 307, buckling at position 300*g* would not be necessary and hence differential speed section 517 would be optional.

Cutoff section 520 is designed to cut at position 309 so that the leading flap 313 and trailing flap 312 of the envelope web 300 on the web can be folded in over the contents at positions 311. Flap 312 is the trailing flap for envelope 300*x* of envelope web 300 shown in FIG. 4 while flap 313 is the leading flap for envelope 300*y* of envelope web 300 of FIG. 4. The leading flap 313 is severed at station 520 from the trailing flap 312 at position 309. Cutoff cylinder 521 and folding die and anvil cylinder 522 of station 520 accomplish the cutting of the envelope 300*x* from envelope 330*y* at position 309 on envelope web 300 and the folding of leading flap 312 over the materials placed at position 311 of envelope 300*x* and the folding of leading flap 313 over the contents positioned at position 311 of envelope 300*y* of continuous envelope web 300 of FIG. 4.

The folded flaps 312 and 313 are caught by pinch conveyors 523 and held in position for folding station 524. Conveyor 523 could, in an alternate embodiment, be hold down bars so that the flaps 312 and 313 are forced and held in place for envelope web 300. Segmented envelope web 300 at position 300*i* of folding station 524 is positioned such that fold bars and conveyors 525 may be used to fold the remaining flaps 302 and 303 over the contents of the envelope and sealing the glued portions against the side flaps 312 and 313. The individually folded and sealed envelopes 300*j* exit folding station 524 as a finished mass mailing product.

Figure 6:
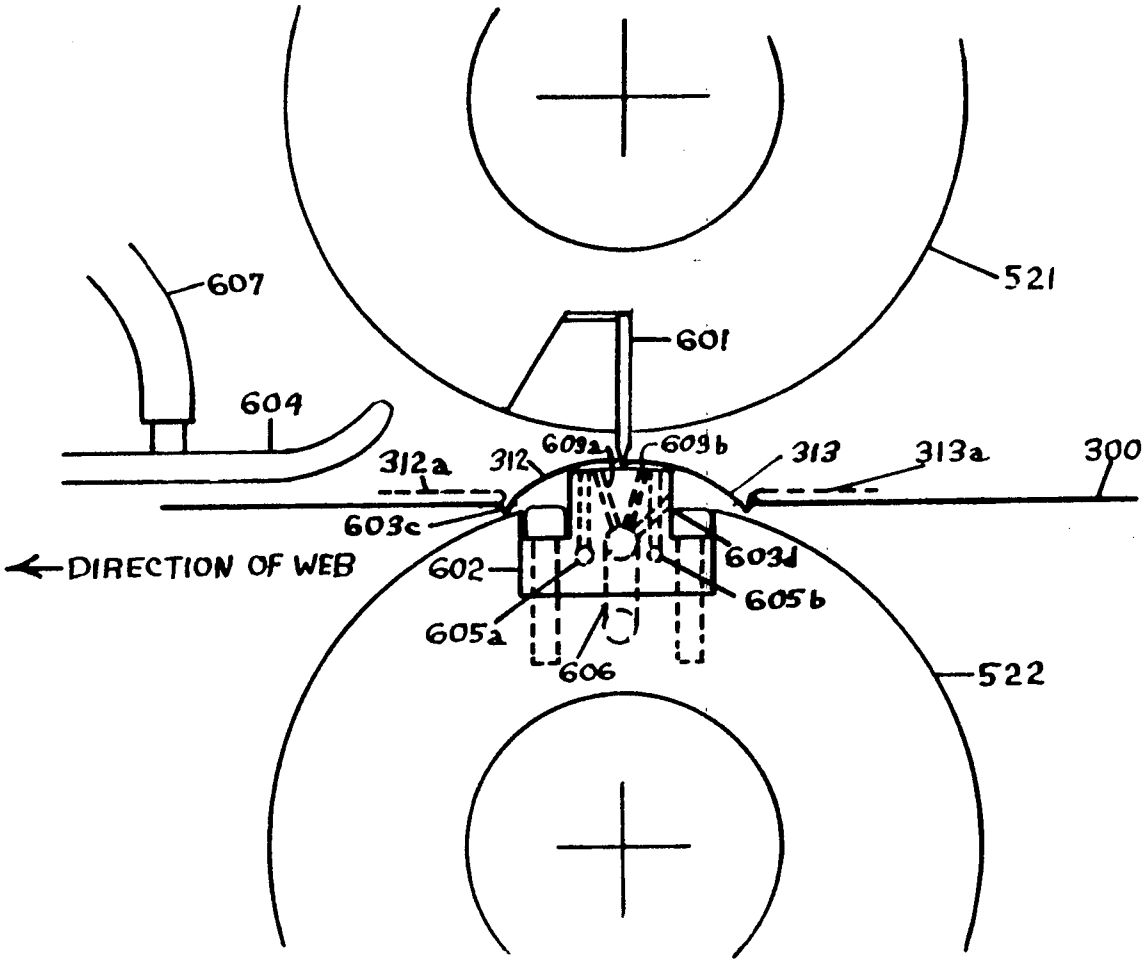
FIG. 6 is a detailed mechanical schematic view of the cut-off and trailing flap folding step in the process shown in FIG. 5.

Referring now to FIG. 6, a detailed view of cutting station 520 is shown. Cutoff cylinder 521 is shown with cutoff blade 601 positioned on hardened anvil insert 602 at the cutoff position 309 of envelope web 300. On envelope web 300 is shown leading flap 313 and trailing flap 312 at the moment or just prior to the pressing of blade 601 onto anvil 602. The dashed portion 312*a* represents trailing flap 312 just after the cutting at point 309 of the envelope web 300 by blade 601 against anvil 602. In a similar fashion, leading flap 313 is shown in position 313*a* just after the pressing of blade 601 against anvil 602 at position 309 of envelope web 300. An air blast applied through channels 603*a* or 603*c* from inside cylinder 522 causes trailing flap 312 to be blown forward into position 312*a* to be caught by hold down shoe 604. Thus, trailing flap 312 at position 312*a* is caught and pressed into position and held there by shoe 604. Also, an air blast from channels 603*b* and 603*d* from inside cylinder 522 causes leading flap 313 to be blown into position 313*a* to also be caught by hold down shoe 604. Air channel 603*b* blasts air out the top of anvil 602 and alternate air channel 603*d* blasts air out the side of anvil 602. Air channels 603*a* and 603*c*, in a similar fashion, may be alternate channels.

In an alternate embodiment, cylinder 522 could be designed to incorporate the gluing function of station 510 in the same station as cutoff station 520 by applying the glue concurrently with the cutting of the web at position 309. Glue channels 605*a* and 605*b* allow the passage of glue onto the flaps 312 and 313 as the flaps are being folded. With glue applied to the back side of flaps 312 and 313 by cylinder 522, air bars would be required in addition to catch shoe 604 to ensure that the glue on the back side of flaps 312 and 313 are not smeared during the final folding process. Air supply 607 supplies air to catch shoe 604.

The air through channels 603*a*, 603*b*, 603*c* and 603*d* is transferred to anvil insert 602 of cylinder 522 by channel 606 internal to the cylinder. Conventional means are used to apply the pressurized air through channel 606 through internal passageways of cylinder 522 (not shown). The pressurized air is preferably pulsed at the correct moment of cutoff when cylinder 521 and cylinder 522 are in registration with a timing valve to ensure the correct timing of the blast of air or by correctly spaced portholes on the sides of cylinder 522 to pulsate the air in a timed fashion.

Figure 7:
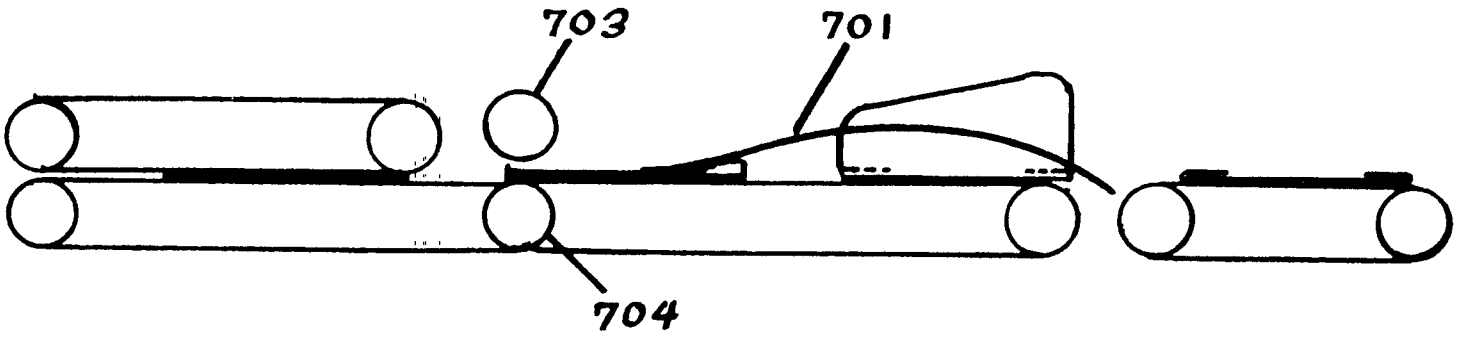
FIG. 7 is a detailed mechanical schematic view of the folding bars used to fold the top and bottom flaps of the envelope in the final folding step in the process shown in FIG. 5.

FIG. 7 shows a detailed view of the final folding process of station 524 of FIG. 5. Folding formers or forming bars 701 are used to fold flaps 302 and 303 on the sides of the envelope web 300 to produce the final folding process. Pinch cylinders 703 and 704 apply pressure to the top and bottom of the final folded envelope to ensure contact of the glue and final sealing of the envelope.

Figure 8:
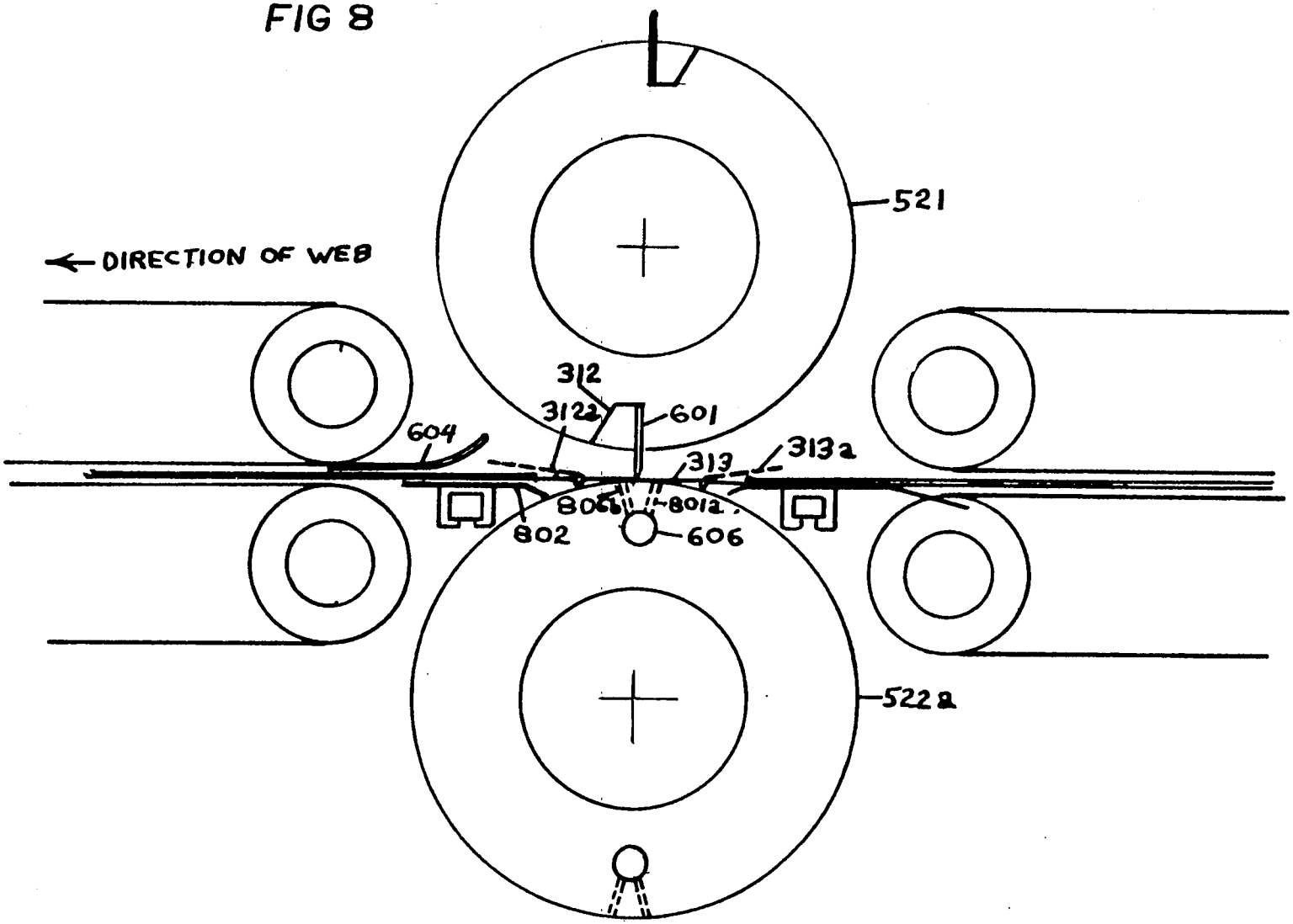
FIG. 8 is a detailed mechanical schematic view of an alternate embodiment of the cut-off and trailing flap folding step in the process shown in FIG. 5.

FIG. 8 shows an alternate implementation of cut-off station 520 shown in detail in FIG. 6. In place of anvil insert 602 on cylinder 522, cylinder 522*a* of FIG. 8 is a hardened cylinder which does not require an anvil for the cut-off. Air passages are incorporated into cylinder 522*a* to accomplish the function of blasting the leading flap 313*a* and trailing flap 312*a* into position by air blasts applied through air passages 801*a* and 801*b* respectively. Depending upon the height of blade 601 on cylinder 521, flaps 312*a* and 313*a* may brush the surface of cylinder 521 while being blown into position. Stripper 802 adjacent to the surface of cylinder of 522*a* may be required in some applications depending upon the stiffness of the paper web, the amount of contents to be inserted into the envelope and other factors. Stripper 802 ensures that the envelope web 300 does not follow around the surface of cylinder 522*a*. As shown in the lower portion of cylinder 522*a*, multiple air passages may be positioned in registration with multiple blades of cut-off cylinder 521 depending upon the size of the envelopes desired, the size of the cylinder, etc. In addition, cylinder 521 could travel at a faster rate of speed than cylinder 522*a* to provide a wiping action to further aide in the folding process by encouraging the folding of flap 312*a*.

Figure 9:
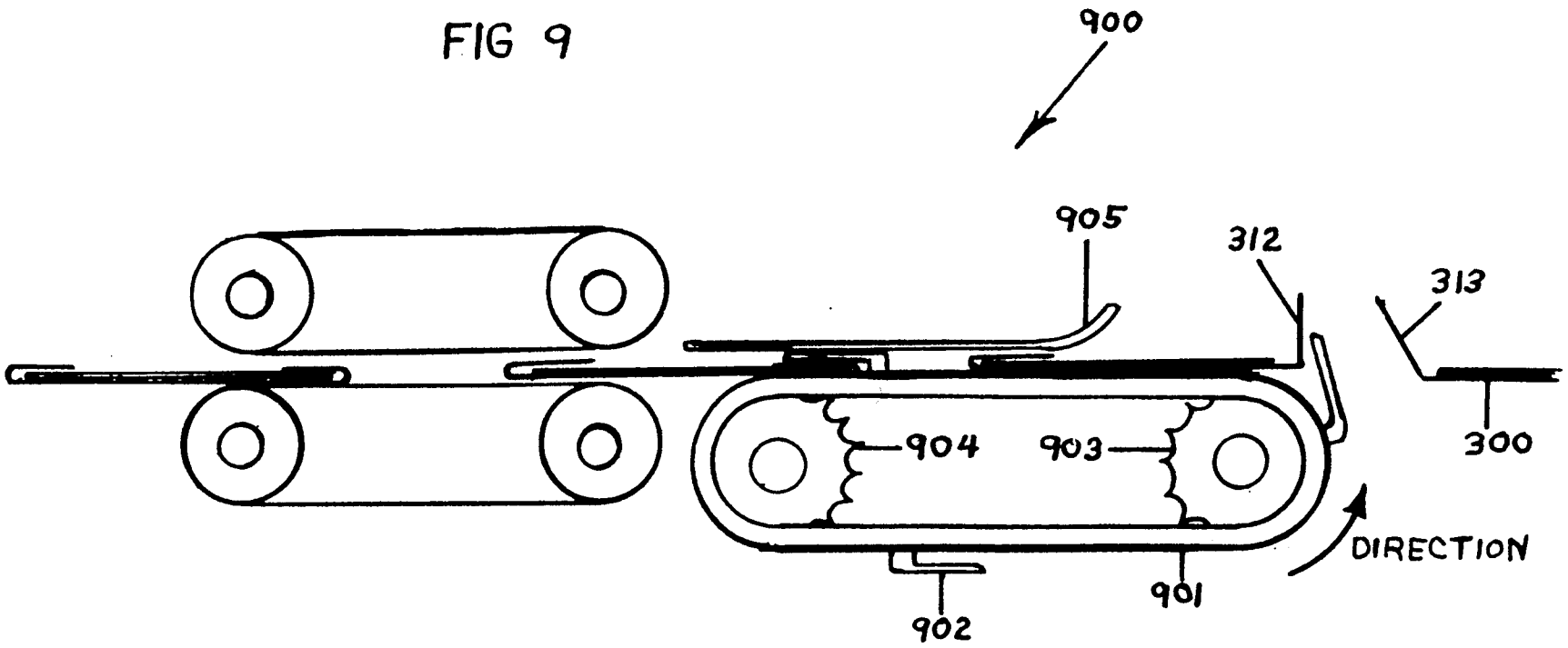
FIG. 9 is a detailed mechanical schematic view of an alternate embodiment of the trailing flap folding station of FIG. 5.

FIG. 9 shows an alternate implementation for folding station 524. As described above, cutoff station 520 uses blasts of air to assist in folding the trailing flap 312. In some applications it may be desirable to assist the folding of the trailing flap by incorporating the mechanism of FIG. 9 into folding station 524. The discontinuous web 300 having inserts 511 is shown entering the trailing flap assist mechanism 900 from the right of FIG. 9 (the web direction being from right to left). The envelope web 300 with the contents 511 are fed onto flighted chain 901 having folding fingers 902 connected to chain 901 at preselected positions. The envelope web 300 is synchronized with flighted chain 901 such that the folding fingers 902 catch trailing flap 312 and assist in folding that flap onto the contents 511 of envelope web 300. The fingers could be narrow, spring steel wire attached at pre-selected links of flighted chain 901. The direction of chain 901 around sprockets 903 and 904 is in the direction shown.

Figure 9A:
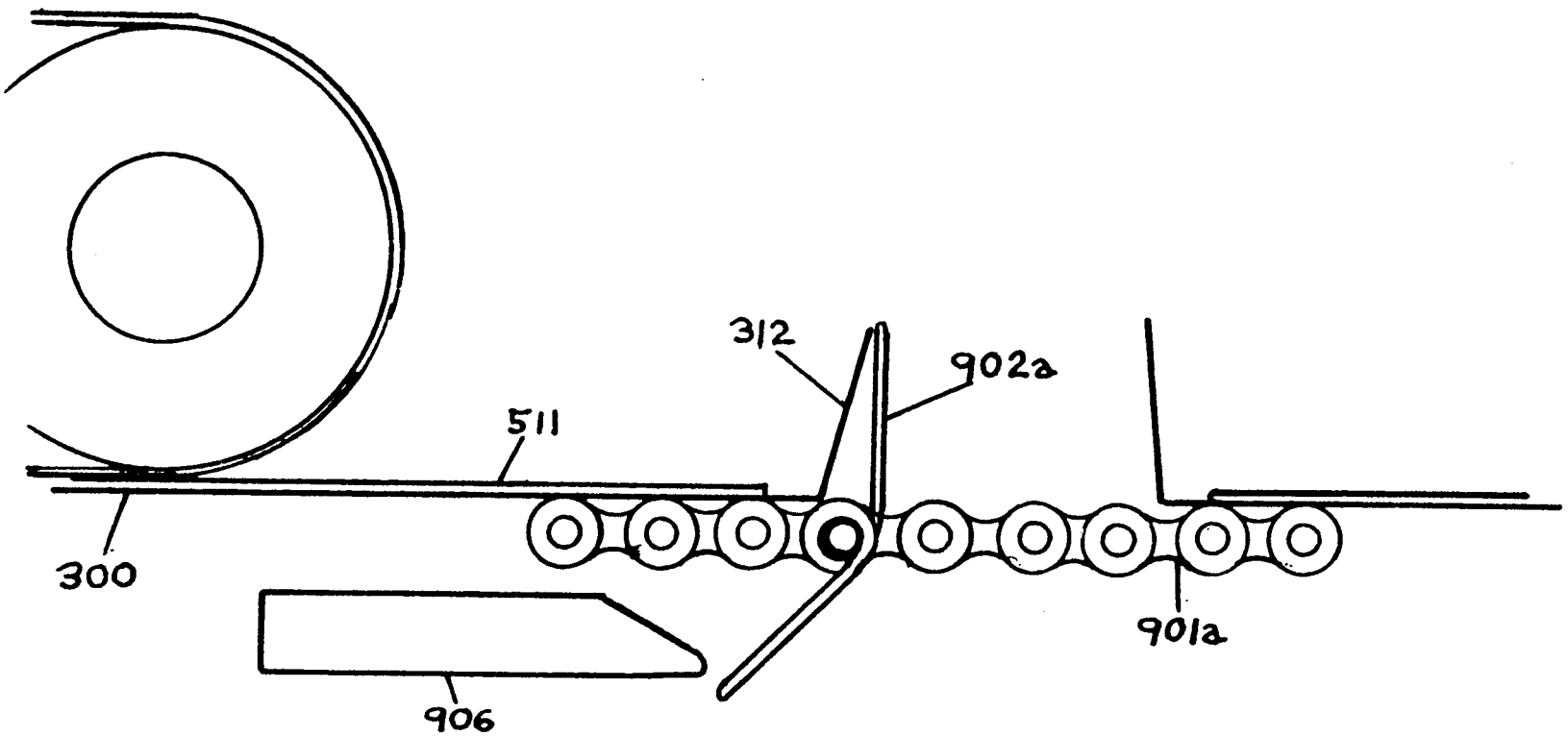
FIG. 9*a* is a detailed mechanical schematic view of a folding finger in one position for the folding station of FIG. 9.
Figure 9B:
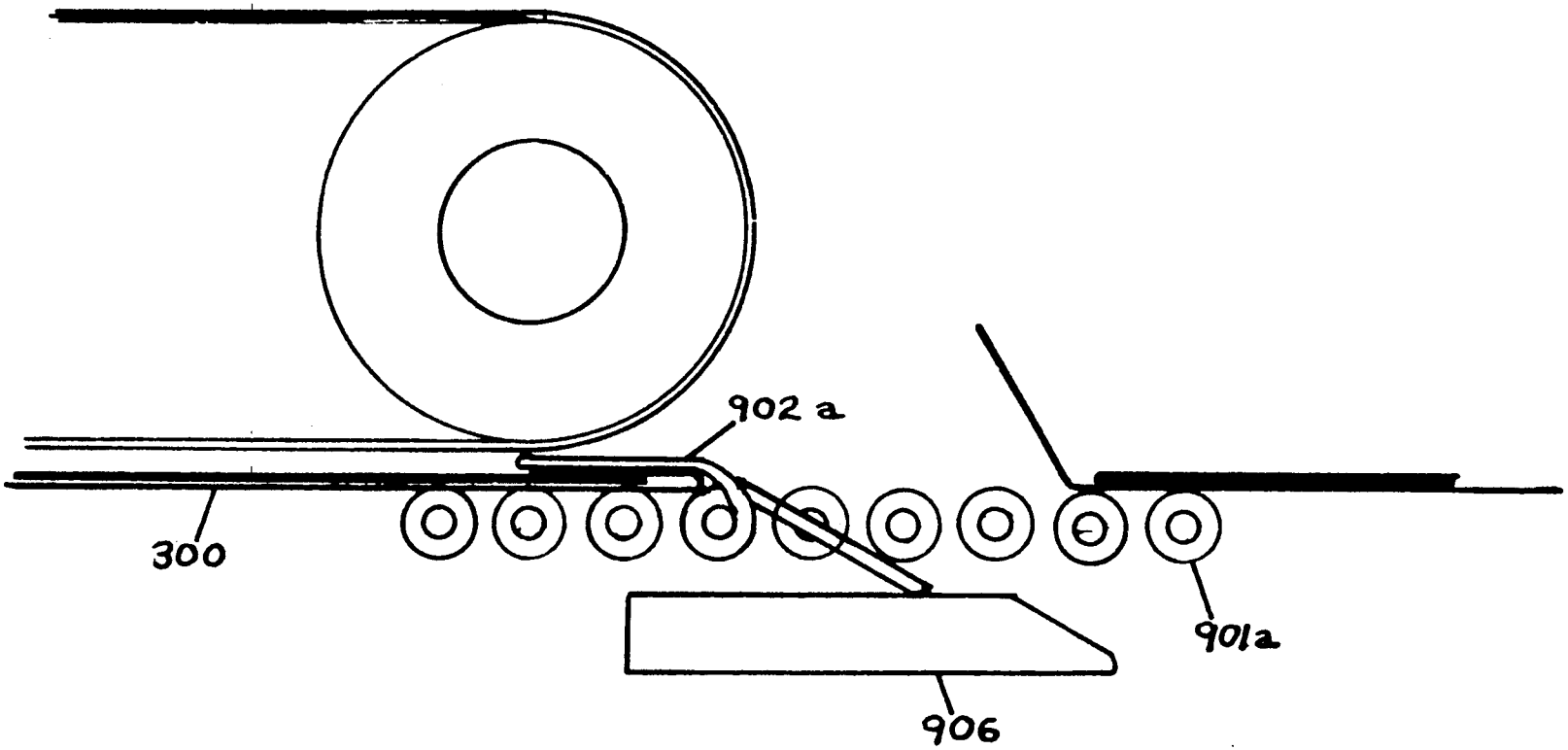
FIG. 9*b* is a detailed mechanical schematic view of a folding finger in a second position of the folding station of FIG. 9.

The leading flap 313 can be folded by conventional means such as folding bars 905 or by other means described above. The folding fingers 902 shown in FIG. 9 are rigidly attached to flighted chain 901. Folding fingers 902 could, in the alternative, be movable segments pivotally attached to chain 901 as shown in FIGS. 9*a* and 9*b*. Folding finger 902*a* shown in FIG. 9*a* is made of spring steel and is a spring loaded folding figure pivotally attached to chain 901*a*. Fixed trip member 906 is positioned at a pre-selected location beneath chain 901*a* to move spring loaded folding finger 902*a* into position to fold trailing flap 312 onto contents 511 of segmented envelope web 300.

Those skilled in the art will readily recognize upon reading and understanding the present disclosure that the folding mechanism of FIG. 9 could be used to assist the folding of trailing flap 312 in cooperation with cutoff station 520. In the alternative, cutoff station 520 could merely be used for cutting the individual envelopes from the envelope web 300 without performing any folding of the trailing flaps 312. The folding station 900 shown in FIG. 9 could then be used as an alternative to blowing trailing flap 312 closed with bursts of air. Thus, folding station 900 and cutoff station 520 could be used in cooperation or in the alternative.

While the present invention has been described in connection with the preferred embodiment thereof, it will be understood that many modifications will be readily apparent to those of ordinary skill in the art, and this application is intended to cover any adaptations or variations thereof. Therefore, it is manifestly intended that this invention be limited only by the claims and equivalents thereof.

What is claimed is:

1. A method of producing a continuous series of envelopes folded around discrete envelope contents, comprising the steps of:

(a) providing a continuous paper web running in a longitudinal direction and having a plurality of envelope shapes with first and second envelope flaps on the sides of the continuous paper web transverse to the direction of the web;

(b) placing the envelope contents at preselected positions on the envelope shapes on the continuous paper web;

(c) severing the continuous paper web between the envelope shapes to form a continuous series of individual envelopes further having leading and trailing envelope flaps;

blowing the trailing envelope flap in the direction of the continuous paper web using compressed air to assist in folding the trailing envelope flap (e) folding the trailing envelope flap in the direction of the continuous paper web and folding the leading envelope flap in the opposite direction of the continuous paper web such that the continuous series of individual envelopes is moved only in the longitudinal direction without stopping the individual envelopes; and (f) folding and sealing the first and second envelope flaps to the leading and trailing envelope flaps to cover the envelope contents.

2. The method according to claim 1 wherein step (a) includes cutting into the sides of the continuous paper web transverse to the direction of the web to form the envelope shapes with the first and second envelope flaps.

3. The method according to claim 1 wherein step (d) further includes blowing the leading envelope flap in the opposite direction of the continuous paper web using compressed air to assist in folding the leading flap.

4. The method according to claim 1 wherein step (d) further includes folding the leading envelope flap in the opposite direction of the continuous paper web using folding bars.

5. The method according to claim 1 further including applying glue to at least one of the flaps to facilitate the sealing.

6. The method according to claim 1 wherein step (c) further includes differentially slowing a portion of the continuous paper web to provide tenting of the paper web between each of the envelope shapes before severing.

7. The method according to claim 6 wherein step (c) further includes scoring the continuous paper web between each of the envelope shapes before differentially slowing the web.

8. The method according to claim 1 wherein a prefold is applied to the sides of the continuous paper web to facilitate the folding of the first and second envelope flaps.

9. An apparatus for producing a continuous series of envelopes folded around discrete envelope contents, comprising:

means for providing a continuous paper web running in a longitudinal direction;

means for cutting into the sides of the continuous paper web transverse to the direction of the web to form envelope shapes having first and second envelope flaps;

means for placing the envelope contents at preselected positions on the envelope shapes on the continuous paper web;

means for severing the continuous paper web between the envelope shapes to form a continuous series of individual envelopes further having leading and trailing envelope flaps;

means for blowing each trailing envelope flap in the direction of the continuous paper web using compressed air to assist in folding the trailing envelope flap;

means for folding each trailing envelope flap in the direction of continuous paper web and means for folding each leading envelope flap in the opposite direction of the continuous paper web such that the continuous series of individual envelopes is moved only in the longitudinal direction without stopping the individual envelopes; and means for folding and sealing the first and second envelope flaps to the leading and trailing envelope flaps to cover the envelope contents.

10. The apparatus according to claim 9 wherein the means for blowing each trailing envelope flap further includes means for blowing each leading envelope flap in the opposite direction of the paper web using compressed air to assist in folding each leading envelope flap.

11. The apparatus according to claim 9 wherein the means for folding each leading envelope flap includes means for folding each leading envelope flap in the direction of the paper web using folding bars.

12. The apparatus according to claim 9 further including means for applying glue to at least one of the flaps to facilitate the means for sealing.

13. The apparatus according to claim 9 further includes means for differentially slowing a portion of the continuous paper web to provide tenting of the paper web between each of the envelope shapes.

14. The apparatus according to claim 13 further includes means for scoring the continuous paper web between each of the envelope shapes.

15. A method of producing a continuous series of envelopes folded around discrete envelope contents, comprising the steps of:

(a) providing a continuous paper web running in a longitudinal direction and having a plurality of envelope shapes each having first and second envelope flaps on the sides of the continuous paper web transverse to the direction of the web;

(b) placing the envelope contents at preselected positions on the envelope shapes on the continuous paper web;

(c) folding each first and second envelope flaps over the envelope contents;

(d) severing the continuous paper web between the envelope shapes to form a continuous series of individual envelopes further having leading and trailing envelope flaps;

(e) blowing each trailing envelope flap in the direction of the continuous paper web using compressed air to assist in folding the trailing envelope flap over the envelope contents; and (f) folding each trailing envelope flap in the direction of the continuous paper web and folding each leading envelope flap in the opposite direction of the continuous paper web such that the continuous series of individual envelopes is moved only in the longitudinal direction without stopping the individual envelopes.

16. The method according to claim 15 wherein step (e) further includes blowing each leading envelope flap in the opposite direction of the continuous paper web using compressed air to assist in folding the leading flap.

17. An apparatus for producing a continuous series of envelopes folded around discrete envelope contents, comprising:

means for providing a continuous paper web running in a longitudinal direction;

means for cutting into the sides of the continuous paper web transverse to the direction of the web to form envelope shapes having first and second envelope flaps;

means for placing the envelope contents at preselected positions on the envelope shapes on the continuous paper web;

means for severing the continuous paper web between the envelope shapes to form a continuous series of individual envelopes further having leading and trailing envelope flaps;

means including folding fingers for contacting and folding each trailing envelope flap in the direction of continuous paper web and means for folding each leading envelope flap in the opposite direction of the continuous paper web such that the continuous series of individual envelopes is moved only in the longitudinal direction without stopping the individual envelopes; and means for folding and sealing the first and second envelope flaps to the leading and trailing envelope flaps.

* * * * *

UNITED STATES PATENT AND TRADEMARK OFFICE

CERTIFICATE OF CORRECTION

PATENT NO. : 5,005,337

DATED : April 9, 1991

INVENTOR(S) : Alvin J. Kluth

It is certified that error appears in the above-identified patent and that said Letters Patent is hereby corrected as shown below:

In the Abstract line 10, please delete "preesnt" and insert therefor --present--.

In Column 3, line 32, please delete "of the envelope The" and insert therefor --of the envelope. The--.

In Column 10, line 1, please delete "blowing the trailing" and insert therefor --(d) blowing the trailing--.

Signed and Sealed this

Eighteenth Day of May, 1993

*Attest:*

Michael K. Kirk

MICHAEL K. KIRK

*Attesting Officer*

*Acting Commissioner of Patents and Trademarks*